US006027093A

United States Patent [19]

Reiher

[11] Patent Number: 6,027,093

[45] Date of Patent: Feb. 22, 2000

[54] MULTI-PURPOSE TABLE ASSEMBLY

[76] Inventor: W. L. Reiher, 4701 N. 55th St., Phoenix, Ariz. 85018

[21] Appl. No.: 09/080,582

[22] Filed: May 18, 1998

[51] Int. Cl.[7] ..... A47B 97/04; A47B 9/00; A47F 5/00

[52] U.S. Cl. ..... 248/451; 248/453; 248/123.2; 108/144.11

[58] Field of Search ..... 248/441.1, 451, 248/453, 454, 123.2; 108/144.11, 147.11, 147.2, 95, 94

[56] References Cited

U.S. PATENT DOCUMENTS

| | | | |
|---|---|---|---|
| 103,593 | 5/1870 | Flint . | |
| 1,011,707 | 12/1911 | Ankeny | 248/452 |
| 1,203,818 | 11/1916 | Trinkl | 108/95 |
| 2,464,690 | 3/1949 | Ketchem | 108/29 |
| 2,612,721 | 10/1952 | Pollard | 248/441.1 |
| 3,351,312 | 11/1967 | Ballas | 248/448 |
| 3,497,882 | 3/1970 | Weeks | 5/332 |
| 3,606,235 | 9/1971 | Young | 248/453 |
| 3,889,816 | 6/1975 | Herryman | 211/43 |
| 3,889,914 | 6/1975 | Torme | 248/445 |
| 4,496,126 | 1/1985 | Melton et al. | 248/447.2 |
| 4,735,151 | 4/1988 | Bisbing | 108/69 |
| 4,987,690 | 1/1991 | Aaldenberg et al. | 40/341 |
| 5,377,946 | 1/1995 | Pannu | 248/456 |
| 5,449,138 | 9/1995 | Ciancio | 248/123.2 |
| 5,720,466 | 2/1998 | Skipper | 248/460 |

*Primary Examiner*—Derek J. Berger
*Assistant Examiner*—David Heisey
*Attorney, Agent, or Firm*—Joseph N. Breaux

[57] ABSTRACT

A multi-purpose table assembly that includes a wheeled base, an adjustable height vertical support extending from the base; a lockable table support bar assembly including a table support bar and a counter balance support bar each oriented at a right angle with respect to the vertical support bar; a user positionable counter balance weight slidably positionable on the counter balance support bar; an upper table assembly supported by the vertical support including a storage shelf and an upper table member; a positionable side table assembly supported on the table support bar and including a first table member and a pivoting table member; and a book holder assembly including a board member, two connecting structures that are attached the board member, a spring finger shaft rotatably positioned through the two connecting structures, a holder arm with a magnetically attractable handle coupled to an end of the spring finger shaft, a securing magnet attached to an upwardly facing surface of the board member and two resilient spring fingers fixedly attached to the spring finger shaft.

16 Claims, 2 Drawing Sheets

MULTI-PURPOSE TABLE ASSEMBLY

TECHNICAL FIELD

The present invention relates to reading tables and the like and more particularly to a multi-purpose table assembly including a wheeled base; an adjustable height vertical support extending from the base; a lockable table support bar assembly including a table support bar and a counter balance support bar each oriented at a right angle with respect to the vertical support bar; a user positionable counter balance weight slidably positionable on the counter balance support bar; an upper table assembly supported by the vertical support including a storage shelf and an upper table member; a positionable side table assembly supported on the table support bar and including a first table member and a pivoting table member; and a book holder assembly including a board member, two connecting structures that are attached to the board member, a spring finger shaft rotatably positioned through the two connecting structures, a holder arm with a magnetically attractable handle coupled to an end of the spring finger shaft, a securing magnet attached to an upwardly facing surface of the board member, and two resilient spring fingers fixedly attached to the spring finger shaft; the pivoting table member including at least one attachment block having a pivoting table locking screw provided therein for locking the pivoting table member in a desired position with respect to the table support bar; the pivoting table member having two attachment holes positioned along a side edge thereof; the board member having two securing pegs extending from the undersurface thereof; each securing peg being sized to frictionally fit within a one of the attachment holes.

BACKGROUND ART

Handicapped and other disabled individuals often enjoy reading but find it difficult to hold a book in a comfortable reading position while maintaining the pages of the book in an open position. It would be a benefit to these individuals to have a table that included a pivoting table member that could be oriented at a desired angle for supporting a book in front of the individual at a comfortable reading angle. Because a pivoting table can become unstable through repositioning, it would of course be a benefit if the pivoting table included a support having a user positionable counter balance weight for counter balancing the pivoting table member. It would be a further benefit if the pivoting table member included a mechanism for maintaining the book in an open configuration to the desired reading pages. Because the pages of the book must be flipped periodically while reading, it would of course be a further benefit to have a book holding assembly that can be operated by individuals with limited dexterity. Additionally, because bedridden individuals may enjoy a variety of reading locations, such as a bed or favorite chair, it would be a benefit to have a pivoting table that was supported by a base and vertical support member that allowed the pivoting table to be positioned at a variety of heights. Because pivoting table might not be large enough to be used for meals or game playing it would be a further benefit to have a first table that could be used in conjunction with the pivoting table to provide an area for dining or playing board games, cards, etc.

GENERAL SUMMARY DISCUSSION OF INVENTION

It is thus an object of the invention to provide a multi-purpose table assembly that includes a pivoting table member that is orientable at a desired angle for supporting a book in front of an individual at a comfortable reading angle.

It is a further object of the invention to provide a multi-purpose table assembly that includes a pivoting table and a user positionable counter balance weight for counter balancing the pivoting table member.

It is a still further object of the invention to provide a multi-purpose table assembly that includes a pivoting table member equipped with book holder mechanism for maintaining a book in an open configuration to the desired reading pages that can be operated by individuals with limited dexterity.

It is a still further object of the invention to provide a multi-purpose table assembly that includes a pivoting table that is supported by a base and an adjustable height vertical support member that support the pivoting table at a variety of heights.

It is a still further object of the invention to provide a multi-purpose table assembly that includes a pivoting table and a first table member that are used in conjunction to provide an area for dining or playing board games, cards, etc.

It is a still further object of the invention to provide a multi-purpose table assembly that includes a wheeled base, an adjustable height vertical support extending from the base; a lockable table support bar assembly including a table support bar and a counter balance support bar each oriented at a right angle with respect to the vertical support bar; a user positionable counter balance weight slidably positionable on the counter balance support bar; an upper table assembly supported by the vertical support including a storage shelf and an upper table member; a positionable side table assembly supported on the table support bar and including a first table member and a pivoting table member; and a book holder assembly including a board member, two connecting structures that are attached to the board member, a spring finger shaft rotatably positioned through the two connecting structures, a holder arm with a magnetically attractable handle coupled to an end of the spring finger shaft, a securing magnet attached to an upwardly facing surface of the board member and two resilient spring fingers fixedly attached to the spring finger shaft; the pivoting table member including at least one attachment block having a pivoting table locking screw provided therein for locking the pivoting table member in a desired position with respect to the table support bar; the pivoting table member having two attachment holes positioned along a side edge thereof; the board member having two securing pegs extending from the undersurface thereof; each securing peg being sized to frictionally fit within a one of the attachment holes.

It is a still further object of the invention to provide a multi-purpose table assembly that accomplishes some or all of the above objects in combination.

Accordingly, a multi-purpose table assembly is provided. The multi-purpose table assembly includes a wheeled base, an adjustable height vertical support extending from the base; a lockable table support bar assembly including a table support bar and a counter balance support bar each oriented at a right angle with respect to the vertical support bar; a user positionable counter balance weight slidably positionable on the counter balance support bar; an upper table assembly supported by the vertical support including a storage shelf and an upper table member; a positionable side table assembly supported on the table support bar and including a first table member and a pivoting table member; and a book holder assembly including a board member, two connecting structures that are attached to the board member, a spring finger shaft rotatably positioned through the two connecting structures, a holder arm with a magnetically attractable handle coupled to an end of the spring finger shaft, a securing magnet attached to an upwardly facing surface of the board member and two resilient spring fingers fixedly attached to the spring finger shaft; the pivoting table member including at least one attachment block having a pivoting table locking screw provided therein for locking the pivoting table member in a desired position with respect to the table support bar; the pivoting table member having two attachment holes positioned along a side edge thereof; the board member having two securing pegs extending from the undersurface thereof; each securing peg being sized to frictionally fit within a one of the attachment holes.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
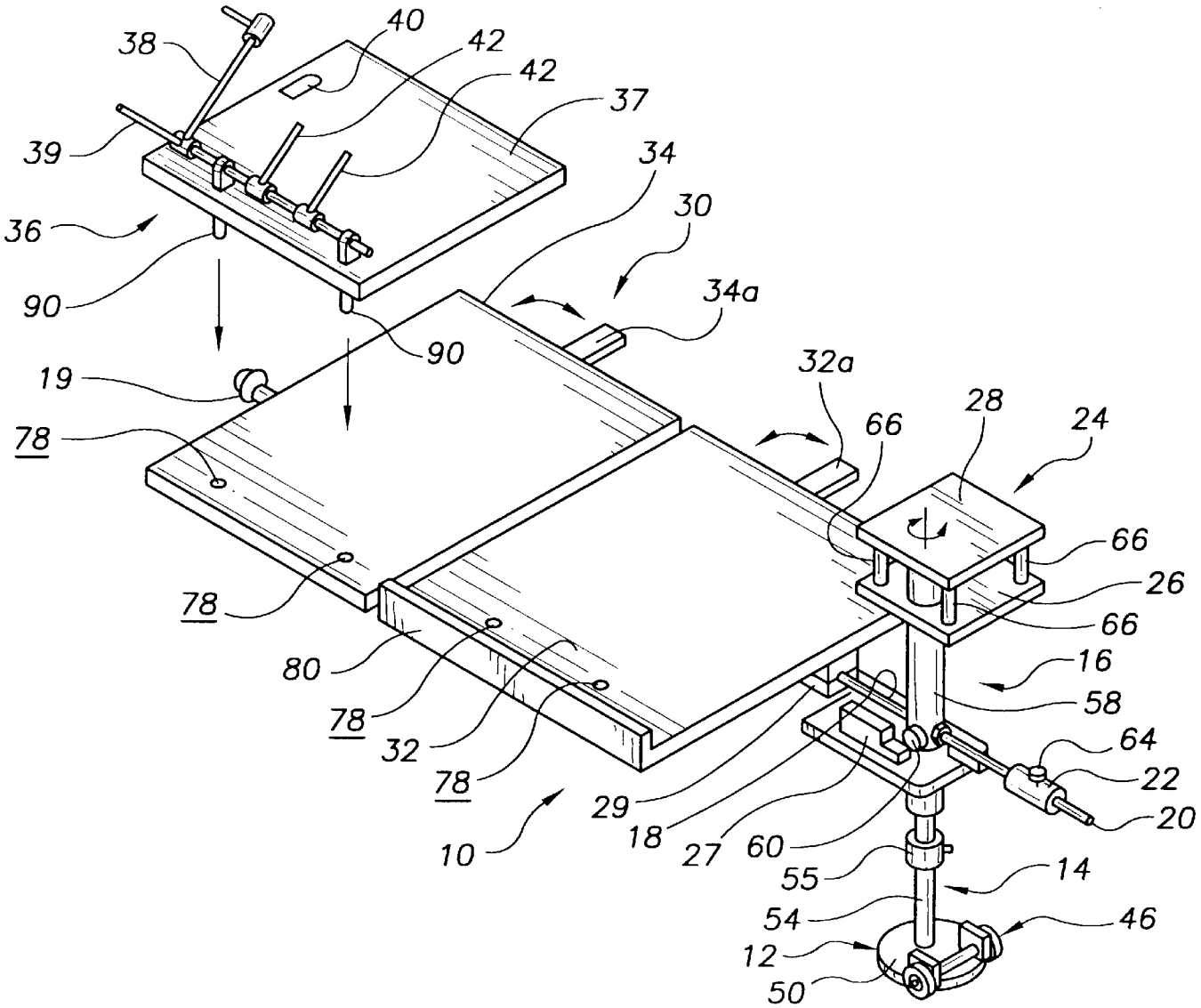
FIG. 1 is a perspective view of an exemplary embodiment of the multi-purpose table assembly of the present invention showing the wheeled base; the adjustable height vertical support; the lockable table support bar assembly including the table support bar and the counter balance support bar; the user positionable counter balance weight; the upper table assembly including the storage shelf and the upper table member; the positionable side table assembly including the first table member and the pivoting table member; and the optional book holder assembly including the holder arm, the securing magnet and the two spring fingers.

FIG. 1 shows an exemplary embodiment of the multi-purpose table assembly of the present invention generally designated by the numeral 10. Multi-purpose table assembly 10 includes a wheeled base, generally designated 12; an adjustable height vertical support, generally designated 14; a lockable table support bar assembly, generally designated 16, including a table support bar 18 having a spherical positioning knob 19 provided at the distal end thereof and a counter balance support bar 20; a user positionable counter balance weight 22 slidably positioned onto counter balance support bar 20; an upper table assembly, generally designated 24, including a storage shelf 26 and an upper table member 28; a positionable side table assembly, generally designated 30, including a pivoting first table member 32 and a pivoting table member 34 each having a pivot out extension 32*a*,34*a*, respectively, for supporting large reading items such as a newspaper; and a book holder assembly, generally designated 36 including a board member 37, a holder arm 38, a positioning arm 39, a securing magnet 40 and two resilient spring fingers 42. First table member 32 can be prevented from rotating about table support bar 18 by sliding a table member lock 27 between the underside of first table member 32 and a support plate 29 upon which table member lock 27 is slidably mounted.

Wheeled base 12 is of cast metal construction and includes a pair of wheels 46 that are lifted above the ground surface when a flat base portion 50 is supported on the ground. A safety height adjustment mechanism 55 is provided for safely making small height adjustments.

Lockable table support bar assembly 16 includes a central rotating portion 58 that is rotatable about upper portion 54 and is lockable at a desired rotational angle by tightening a bar assembly locking screw 60. In this embodiment, table support bar 18 and counter balance support bar 20 are constructed from a lengths of stainless steel rod material that are each screwed into central rotating portion 58. User positionable counter balance weight 22 is constructed of steel and is lockable in a user selected position along counter balance support bar 20 by tightening a counter balance locking screw 64. Upper table assembly 24 is mounted to central rotating portion 58 and includes a rectangular shaped storage shelf 26 and a rectangular shaped upper table member 28 that are spaced apart by four corner spacers 66 (only three shown).

Figure 2:
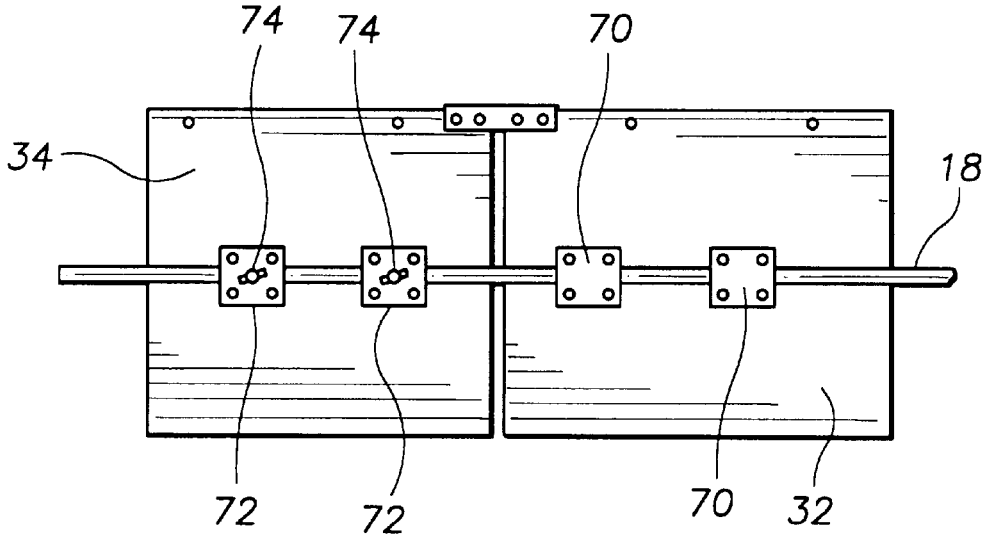
FIG. 2 is a underside plan view of the positionable side table assembly including a portion of the table support bar attached to the first table member and the pivoting table member; the two pivoting table member attachment blocks including the pivoting table locking screws; the two attachment holes positioned along the front side edges of the first table member and the pivoting table member; and the anti-rotation plate permanently secured to the pivoting table member.

With respect to FIG. 2, first table member 32 is affixed to table support bar 18 by two first table attachment blocks 70. Pivoting table member 34 is pivotally attached to table support bar 18 by two pivoting table member attachment blocks 72. Pivoting table member 34 is lockable with respect to table support bar 18 by tightening the pivoting table locking screws 74 that are provided in each pivoting table member attachment block 72.

Figure 3:
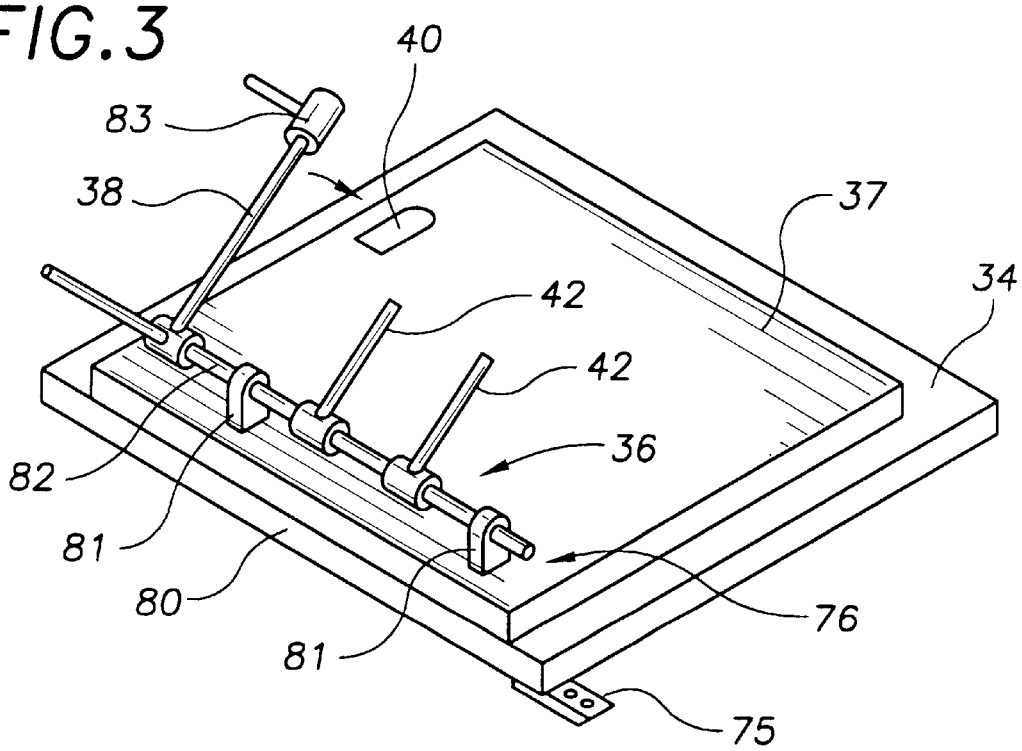
FIG. 3 is a perspective view of the pivoting table member and the book holder assembly in isolation showing the rectangular shaped pivoting table member with the two attachment holes positioned along the side edge thereof and the anti-rotation plate permanently secured to the pivoting table member; and the book holder assembly including the board member, the two connecting structures, the spring finger shaft rotatably positioned through the two connecting structures, the holder arm with the magnetically attractable handle, the securing magnet attached to the upwardly acing surface of the board member and the two spring fingers fixedly attached to the spring finger shaft.

With reference now to FIG. 3, pivoting table member 34 has an anti-rotation plate 75 extending from an undersurface thereof that contacts first table member 32 (FIG. 2) to prevent pivoting table member 34 from rotating completely about table support bar 18 (FIG. 2) and is used to secure pivoting table member 18 to first table member 32 (FIG. 2) when a large eating or game playing area is desired. First table member 32 and pivoting table member 34 each also include two spaced attachment holes 78 (FIG. 1) that are positioned along the user facing side edge 80 thereof. Attachment holes 78 (FIG. 1) are used to secure book holder assembly 36 to either first table member 32 or pivoting table member 34.

In this embodiment book holder assembly 36 includes a board member 37, two connecting structures, generally designated 81; a spring finger shaft 82 that is rotatably positioned through the two connecting structures 81; a holder arm 38 including a magnetically attractable handle 83, a securing magnet 40 that is inlaid into the surface of board member 37; and the two spring fingers 42 that are fixedly attached to spring finger shaft 82. Holder arm 38 is oriented with respect to the two spring fingers 42 such that when magnetically attractable handle 83 is in contact with securing magnet 40, the two spring fingers 42 are positioned above pivoting table member 34 a distance suitable for maintaining the pages of a book in an open position. With reference back to FIG. 1, board member 37 has tow securing pegs 90 extending from a bottom surface thereof. Each securing peg 90 is sized to frictionally fit within an attachment hole 78 and hold book holder assembly 36 (FIG. 3) to either first table member 32 or pivoting table member 34 (FIG. 3).

It can be seen from the preceding description that a multi-purpose table assembly has been provided that includes a pivoting table member that is orientable at a desired angle for supporting a book in front of an individual at a comfortable reading angle; that includes a pivoting table and a user positionable counter balance weight for counter balancing the pivoting table member; that includes a pivoting table member equipped with book holder mechanism for maintaining a book in an open configuration to the desired reading pages that can be operated by individuals with limited dexterity; that includes a pivoting table that is supported by a base and an adjustable height vertical support member that support the pivoting table at a variety of heights; that includes a pivoting table and a first table member that are used in conjunction to provide an area for dining or playing board games, cards, etc.; and that includes a wheeled base, an adjustable height vertical support extending from the base; a lockable table support bar assembly including a table support bar and a counter balance support bar each oriented at a right angle with respect to the vertical support bar; a user positionable counter balance weight slidably positionable on the counter balance support bar; an upper table assembly supported by the vertical support including a storage shelf and an upper table member; a positionable side table assembly supported on the table support bar and including a first table member and a pivoting table member; and a book holder assembly including a board member, two connecting structures that are attached to board member, a spring finger shaft rotatably positioned through the two connecting structures, a holder arm with a magnetically attractable handle coupled to an end of the spring finger shaft, a securing magnet attached to an upwardly facing surface of the board member and two resilient spring fingers fixedly attached to the spring finger shaft; the pivoting table member including at least one attachment block having a pivoting table locking screw provided therein for locking the pivoting table member in a desired position with respect to the table support bar; the pivoting table member having two attachment holes positioned along a side edge thereof; the board member including securing pegs extending from the undersurface thereof that are sized to frictionally fit within the two attachment holes provided in each of the first and pivoting table members.

It is noted that the embodiment of the multi-purpose table assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A multi-purpose table assembly comprising:

a base;

an adjustable height vertical support extending from said base;

a lockable table support bar assembly including a table support bar oriented at a right angle with respect to the vertical support;

a positionable side table assembly supported on said table support bar and including a first table member and a pivoting table member; and a book holder assembly including a board member, two connecting structures that are attached to said board member, a spring finger shaft rotatably positioned through said two connecting structures, a holder arm with a magnetically attractable handle coupled to an end of said spring finger shaft, a securing magnet attached to an upwardly facing surface of said board member, two securing pegs extending from an undersurface of said board member and two resilient spring fingers fixedly attached to said spring finger shaft;

said pivoting table member including at least one attachment block having a pivoting table locking screw provided therein for locking said pivoting table member in a desired position with respect to said table support bar;

said pivoting table member having two attachment holes positioned along a side edge thereof;

each of said securing pegs being sized to frictionally fit within one of said attachment holes.

2. The multi-purpose table assembly of claim 1, wherein:

said base is wheeled.

3. The multi-purpose table assembly of claim 2, further including:

an upper table assembly supported by said vertical support including a storage shelf and an upper table member.

4. The multi-purpose table assembly of claim 3 wherein:

said lockable table support bar assembly is rotatable about an axis defined by said vertical support.

5. The multi-purpose table assembly of claim 3 wherein:

said lockable table support bar assembly further includes a counter balance support bar oriented at a right angle with respect to said vertical support bar; and said multi-purpose table assembly further includes a user positionable counter balance weight slidably positionable on said counter balance support bar.

6. The multi-purpose table assembly of claim 4 wherein:

said lockable table support bar assembly further includes a counter balance support bar oriented at a right angle with respect to said vertical support bar; and said multi-purpose table assembly further includes a user positionable counter balance weight slidably positionable on said counter balance support bar.

7. The multi-purpose table assembly of claim 2 wherein:

said lockable table support bar assembly is rotatable about an axis defined by said vertical support.

8. The multi-purpose table assembly of claim 7 wherein:

said lockable table support bar assembly further includes a counter balance support bar oriented at a right angle with respect to said vertical support bar; and said multi-purpose table assembly further includes a user positionable counter balance weight slidably positionable on said counter balance support bar.

9. The multi-purpose table assembly of claim 2 wherein:

said lockable table support bar assembly further includes a counter balance support bar oriented at a right angle with respect to said vertical support bar; and said multi-purpose table assembly further includes a user positionable counter balance weight slidably positionable on said counter balance support bar.

10. The multi-purpose table assembly of claim 1, further including:

an upper table assembly supported by said vertical support including a storage shelf and an upper table member.

11. The multi-purpose table assembly of claim 10 wherein:

said lockable table support bar assembly is rotatable about an axis defined by said vertical support.

12. The multi-purpose table assembly of claim 11 wherein:

said lockable table support bar assembly further includes a counter balance support bar oriented at a right angle with respect to said vertical support bar; and said multi-purpose table assembly further includes a user positionable counter balance weight slidably positionable on said counter balance support bar.

13. The multi-purpose table assembly of claim 10 wherein:

said lockable table support bar assembly further includes a counter balance bar oriented at a right angle with respect to said vertical support bar; and said multi-purpose table assembly further includes a user positionable counter balance weight slidably positionable on said counter balance support bar.

14. The multi-purpose table assembly of claim 1 wherein:

said lockable table support bar assembly is rotatable about an axis defined by said vertical support.

15. The multi-purpose table assembly of claim 14 wherein:

said lockable table support bar assembly further includes a counter balance support bar oriented at a right angle with respect to said vertical support bar; and said multi-purpose table assembly further includes a user positionable counter balance weight slidably positionable on said counter balance support bar.

16. The multi-purpose table assembly of claim 1 wherein:

said lockable table support bar assembly further includes a counter balance support bar oriented at a right angle with respect to said vertical support bar; and said multi-purpose table assembly further includes a user positionable counter balance weight slidably positionable on said counter balance support bar.

* * * * *